US005211330A

United States Patent [19]

Frey

[11] Patent Number: 5,211,330

[45] Date of Patent: May 18, 1993

[54] FIVE-SPEED BOX FOLDABLE FROM A BLANK AND USEFUL AS AN OPEN CONTAINER, OR AS AN END LID FOR A LARGER PACKAGE

[75] Inventor: Albert Frey, Dirlewang-Helchenried, Fed. Rep. of Germany

[73] Assignee: Albert Frey Verpackungsentwicklungen und Vertriebes-GmbH, Dirlewang-Helchenried, Fed. Rep. of Germany

[21] Appl. No.: 864,294

[22] Filed: Apr. 6, 1992

[30] Foreign Application Priority Data

Apr. 8, 1991 [DE] Fed. Rep. of Germany .... 9104391.3

[51] Int. Cl.[5] ..... B65D 5/22

[52] U.S. Cl. ..... 229/175; 229/23 BT; 229/162

[58] Field of Search ..... 229/174, 175, 176, 162, 229/23 R, 23 BT; 493/162

[56] References Cited

U.S. PATENT DOCUMENTS

| | | | |
|---|---|---|---|
| 695,205 | 3/1902 | Goodnow | 229/175 |
| 1,144,746 | 6/1915 | Zeigler | 229/175 |
| 1,726,682 | 9/1929 | Scholes | 229/176 |
| 1,755,694 | 4/1930 | Keppler | 229/175 |
| 1,778,462 | 10/1930 | Nourse et al. | 229/175 |
| 2,143,308 | 1/1939 | Flach | 229/175 |
| 2,179,421 | 11/1939 | Murray | 229/174 |
| 2,453,614 | 11/1948 | Belsinger | 229/23 R |
| 2,859,906 | 11/1958 | Guyer | 229/175 |
| 2,915,235 | 12/1959 | Rueckert | 229/23 R |
| 3,137,434 | 6/1964 | Berg | 229/175 |
| 3,910,483 | 10/1975 | Ritter | 229/162 |
| 4,037,777 | 7/1977 | Maughan | 229/162 |
| 4,055,293 | 10/1977 | Stramaglia | 229/176 |
| 4,127,228 | 11/1978 | Hall | 229/162 |

FOREIGN PATENT DOCUMENTS 3302972 1/1989 Fed. Rep. of Germany .

*Primary Examiner*—Gary E. Elkins
*Attorney, Agent, or Firm*—Gerald E. Linden

[57] ABSTRACT

A box is folded from a flat blank of sheet material. The flat blank of sheet material has a bottom portion, two side walls correspondingly connected via folds to first opposing edges of the bottom portion, and two end walls correspondingly connected via folds to second opposing edges of the bottom portion. The second edges extend perpendicular to the first edges. The end walls are of "double-wall" design, including inner and outer wall portions. Connecting portions are provided, with each connecting portion connected to intersecting edges of a side wall and a corresponding inner wall portion of an end wall and symmetrically foldable about a fold diagonally extending from a corner of the bottom portion such that in an erected state of the box the connecting portions are foldedly received between the corresponding inner and outer wall portions of each end wall. Engaging structures are provided at a vertical edge of the side walls for resiliently arresting the inner portions of the end walls for retaining them in a folded upright position. There is further provided a method of folding (erecting) a box from a flat blank of sheet material.

12 Claims, 5 Drawing Sheets

FIVE-SPEED BOX FOLDABLE FROM A BLANK AND USEFUL AS AN OPEN CONTAINER, OR AS AN END LID FOR A LARGER PACKAGE

FIELD OF THE INVENTION

The invention relates to a folded box, and in particular to a box which may be folded from a flat blank of carton material or the like.

BACKGROUND OF THE INVENTION

German Patent No. 33 02 972 discloses a folded box including end and side walls connected via fold lines to a bottom, and connected via further fold lines to lateral connecting flaps which may be folded inward. The flaps engage corresponding recesses at the ends of the side walls maintaining the box, when folded, in an erected or upright configuration. This patent is exemplary of the problem that folding, un-folding, and re-folding a box several times adversely affects the stability of the flaps, and in turn adversely affects the stability of the erected box.

DISCLOSURE OF THE INVENTION

It is therefore an object of the present invention to provide a folded box which may be folded, un-folded and re-folded, several times, without losing its structural integrity.

It is a further object of the present invention to provide a folded box made of one flat blank of sheet material, and which may be easily assembled (erected) and disassembled, even by unskilled persons.

It is a further object of the present invention to provide a five-sided (open at one end) box, and a technique for easily folding same from a flat blank of sheet material.

It is a further object of the present invention to provide a method for folding a flat blank of sheet material into a box configuration.

According to the present invention, a flat (two dimensional) blank of material is delineated by a pattern of fold lines (i.e, weakenings formed in the blank) into several portions, such that the various portions may be folded towards and against one another, and the like, to form a three dimensional box structure.

There are provided, as delineated by the fold lines:

1. a rectangular (including square) bottom portion (panel) having four edges delineated by fold lines;

2. two opposing outer side wall portions (panels) connected (i.e., delineated by corresponding fold lines) to first opposing edges of the bottom portion;

3. two inner side wall portions (panels) extending from an outer edge (fold line) of the outer side wall portions;

4. two opposing outer end wall portions (panels) connected to second, alternate, opposing edges of the bottom portion;

5. two inner end wall portions (panels) extending from an outer edge (fold line) of the outer end wall portions;

6. four connecting portions (panels), one disposed at each of the four corners of the bottom portion, and connected via fold lines to one end of a respective outer side wall and one end of a respective outer end wall, and provided with a diagonal fold line extending diagonally from the corner of the bottom portion so that the connecting portion may be folded symmetrically in half.

The various panels set forth above are all integral with the carton blank, and are defined by the fold lines and/or peripheral edges of the cut blank.

The box is erected by folding the various side and end wall portions inward (towards the bottom portion), namely by:

1. folding the inner sidewall portions over the outer sidewall portions;

2. partially folding the outer end wall portions and outer side wall portions, while folding the connecting portions.

3. continuing to fold the outer end wall portions and folding the inner end wall portions over the outer end wall portions, while causing the folded connecting portion to be disposed between the folded inner and outer end wall portions.

There are further provided means at the outer edges of the inner end and side walls for interlocking the end and side walls together when the box is folded to retain the box in its erected state. These means are preferably notches on opposite outer corners of the inner sidewalls, and corresponding tabs on opposite outer corners of the inner end walls. The tabs fit resiliently into recesses formed by the notches, yet sufficiently positively interlocking with the notches to retain the box in an erected condition. Additionally, holes in the outer side wall panels may be provided in alignment with the notches in the inner side wall panels (when folded), to allow for easy un-seating of the tabs (flaps) from the notches (recesses).

The above-described construction and erection of a box allows for easily erecting the box from a flat blank of material, and allows for un-folding and re-folding of the box without sacrificing the structural integrity of the re-folded box. This ability to refold the box several times while maintaining stability (when folded) is due in part to the low engaging force of the tabs and notches, and in further part is due to the connecting portions aiding in holding the erected box together.

Other objects, features and advantages of the invention will become apparent from the description that follows.

DETAILED DESCRIPTION OF THE INVENTION

Figure 1A:
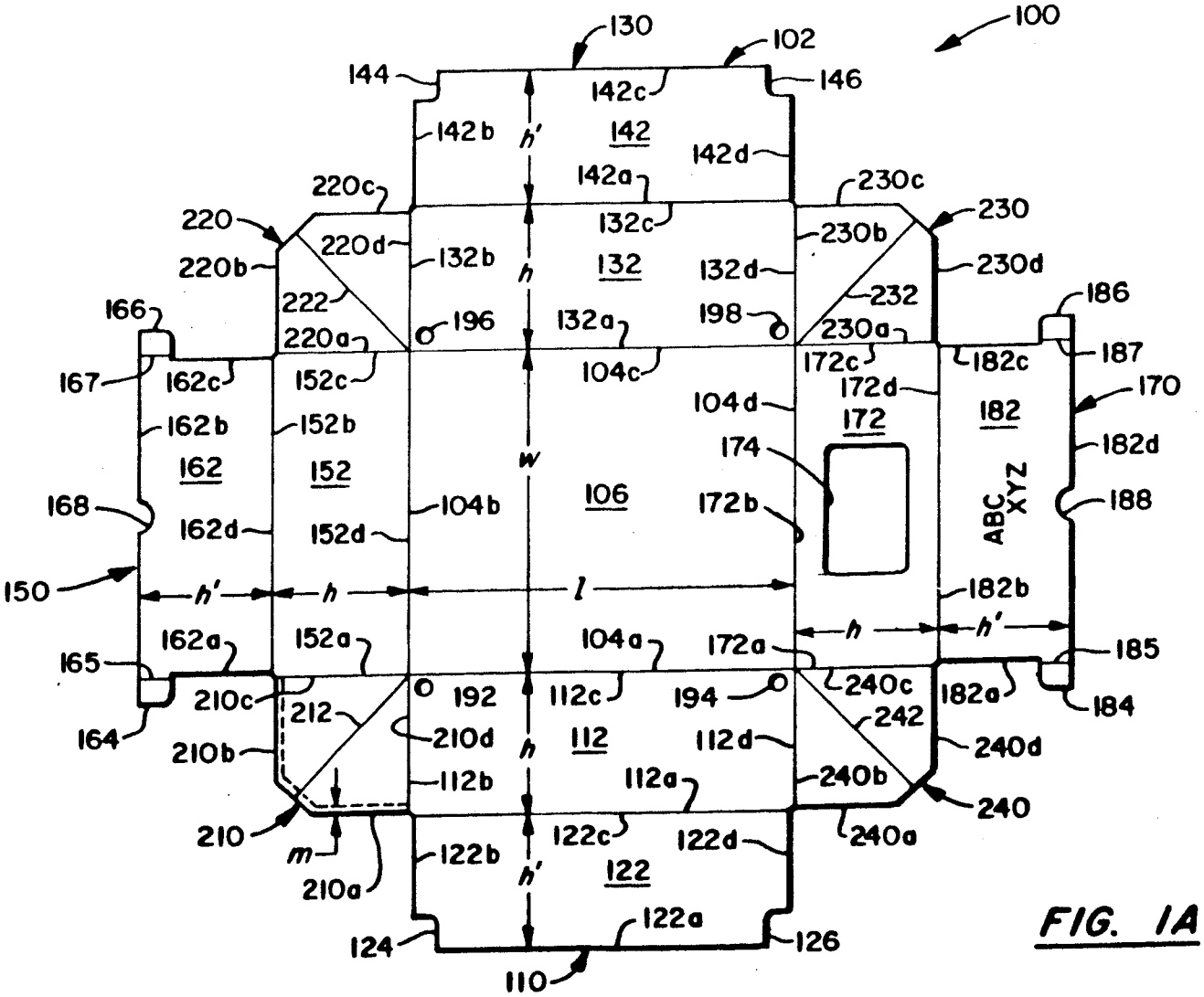
FIG. 1A is a plan view of a blank of material, cut and patterned with fold lines, for forming the box of the present invention.

FIG. 1A shows a blank 100 of sheet material which has been cut out into a generally "cruciform" shape, as indicated by the lines 102 bordering the blank 100.

Various panels are defined by various fold lines formed (such as by pressure) in the blank 100. Further, there are various notches, tabs and openings formed in the blank. Generally, techniques for cutting, forming fold lines, notches, tabs and openings in a blank, and folding the flat (two-dimensional) blank into a three-dimensional box structure, are well known, and do not require further description herein.

According to the invention, the blank 100 is formed in a specific way for a specific purpose.

In a central region of the blank 100, four fold lines 104*a*, 104*b*, 104*c* and 104*d* define a bottom or base portion 106 of the box (i.e., of the box structure which will be formed when the various panels of the blank are appropriately folded). The fold lines do not cut through the blank, but can be considered to form four "edges" of the base portion. The base portion is shown rectangular, having a length "l" and shorter width "w", but it is within the scope of this invention that the base portion is square (l = w). The length of the edge 104*a* is equal to the length of the opposite edge 104*c*, and the width of the edge 104*b* is equal to its opposite edge 104*d*.

A first side panel 110 is formed as follows, from an outer side panel 112 and an inner side panel 122.

A first outer side panel 112 has an edge 112*c* contiguous with and of the same length as the edge 104*a* of the base portion 106. In essence, the outer side panel 112 extends from the edge 104*a* of the base portion. The outer side panel 112 is rectangular, and has an edge 112*a*, parallel and opposite to the edge 112*c*, formed by a fold line.

Two additional fold lines 112*b* and 112*d* form the other two edges of the rectangular outer side panel 112, and are perpendicular to the folds (edges) 112*a* and 112*c*. The fold line 112*b* is collinear with the fold line 104*b*, and the fold line 112*d* is collinear with the fold line 104*d*. A dimension "h" is defined between the edges 112*a* and 112*c*, as the height of the outer side panel 112.

A first inner side panel 122 has an edge 122*c* contiguous with and of slightly lesser (about one tenth of an inch) length as the edge 112*a* of the outer side panel 112 In essence, the inner side panel 122 extends from the edge 112*a* of outer side panel 112. The inner side panel 122 is rectangular, and has an outer edge 122*a*, parallel and opposite to the edge 112*c*, formed by a fold line.

The inner side panel 122 has two additional edges 122*b* and 122*d*, which are parallel to each other, which are formed when cutting the periphery 102 of the blank, and which extend parallel to but slightly closer together than the fold lines 112*b* and 112*d* of the outer side wall 112. A dimension "h'" is defined between the edges 122*a* and 122*c*, as the height of the inner side panel 122, and is no greater than the dimension "h", preferably about one tenth of an inch less than "h" (h = h' + 0.1).

An outer corner of the inner side wall panel 122 is provided with a notch 124, extending into the panel from the edge 122*a* near the edge 122*b*, and from the edge 122*b* near the edge 122*a*. An opposite corner of the inner side wall panel 122 is provided with a similar notch 126, extending into the panel from the edge 122*a* near the edge 122*d*, and from the edge 122*d* near the edge 122*a*. As will become evident hereinbelow, the notches 124 and 126 cooperate with mating tabs (flaps) to maintain the blank in a folded (box) configuration.

A second side panel 130 is formed as follows, from an outer side panel 132 and an inner side panel 142.

A first outer side panel 132 has an edge 132*a*, contiguous with and of the same length as the edge 104*c* of the base portion 106. In essence, the outer side panel 132 extends from the edge 104*c* of the base portion. The outer side panel 132 is rectangular, and has an edge 132*c*, parallel and opposite to the edge 132*a*, formed by a fold line.

Two additional fold lines 132*b* and 132*d* form the other two edges of the rectangular outer side panel 132, and are perpendicular to the folds (edges) 132*a* and 132*c*. The fold line 132*b* is collinear with the fold line 104*b*, and the fold line 132*d* is collinear with the fold line 104*d*. A dimension "h" is defined between the edges 132*a* and 132*c*, as the height of the outer side panel 132.

A first inner side panel 142 has an edge 142*a* contiguous with and of slightly lesser length as the edge 132*c* of the outer side panel 132 In essence, the inner side panel 142 extends from the edge 132*c* of outer side panel 132. The inner side panel 142 is rectangular, and has an outer edge 142*c*, parallel and opposite to the edge 142*a*.

The inner side panel 142 has two additional edges 142*b* and 142*d*, which are parallel to each other, which are formed when cutting the periphery 102 of the blank, and which extend parallel to but slightly closer together than the fold lines 132*b* and 132*d* of the outer side wall 132. A dimension "h'" is defined between the edges 142*a* and 142*c*, as the height of the outer side panel 142, and is no greater than the dimension "h".

An outer corner of the inner side wall panel 142 is provided with a notch 144, extending into the panel from the edge 142*c* near the edge 142*b*, and from the edge 142*b* near the edge 142*c*. An opposite corner of the inner side wall panel 142 is provided with a similar notch 146, extending into the panel from the edge 142*c* near the edge 142*d*, and from the edge 142*d* near the edge 142*c*. As will become evident hereinbelow, the notches 144 and 146 cooperate with mating tabs (flaps) to maintain the blank in a folded (box) configuration.

The side wall panels 110 and 130 are essentially "mirror" images of one another.

It should be noted that the terms "outer" and "inner", as applied to the side panels, are descriptive of the ultimate position of these panels either within (inner) or without (outer) the assembled box.

A first end panel 150 is formed as follows, from an outer end panel 152 and an inner end panel 162.

A first outer end panel 152 has an edge 152*d* contiguous with and of the same width (w) as the edge 104*b* of the base portion (panel) 106. In essence, the outer end panel 152 extends from the edge 104*b* of the base portion. The outer end panel 152 is rectangular, and has an edge 152*b*, parallel and opposite to the edge 152*d*, formed by a fold line.

Two additional fold lines 152*a* and 152*c* form the other two edges of the rectangular outer end panel 152, and are perpendicular to the folds (edges) 152*b* and 152*d*. The fold line 152*a* is collinear with the fold line 104*a*, and the fold line 152*c* is collinear with the fold line 104*c*. A dimension "h" is defined between the edges 152*b* and 152*d*, as the height of the outer end panel 152.

A first inner end panel 162 has an edge 162*d* contiguous with and of slightly lesser length as the edge 152*b* of the outer end panel 152 In essence, the inner end panel 162 extends from the edge 152*b* of outer end panel 152. The inner end panel 162 is rectangular, and has an outer edge 162*b*, parallel and opposite to the edge 162*d*.

The inner end panel 162 has two additional edges 162*a* and 162*c*, which are parallel to each other, which are formed when cutting the periphery 102 of the blank, and which extend parallel to but slightly closer together than the fold lines 152*a* and 152*c* of the outer end wall 152. A dimension "h'" is defined between the edges 162*b* and 162*d*, as the height of the inner end panel 162, and is no greater than the dimension "h".

An outer corner of the inner end wall panel 162 is provided with a tab 164, extending from the edge 162*a* of the panel 162 at a position adjacent to the outer edge 162*b*. The tab 164 is delineated from the panel 162 by a fold line 165, which (as will be seen hereinbelow) allows the tab 164 to be folded at ninety degrees to the panel 162. An opposite corner of the inner end wall panel 162 is provided with a similar tab 166, extending from the edge 162*c* of the panel 162 at a position adjacent to the outer edge 162*b*. The tab 166 is delineated from the panel 162 by a fold line 167, which (as will be seen hereinbelow) allows the tab 166 to be folded at ninety degrees to the panel 162. The tabs 164 and 166 cooperate (mate) with the aforementioned notches 124 and 144, respectively, to keep the folded (assembled) box in a folded configuration. The tabs 164 and 166 are sized and shaped to fit easily but securely, such as by a slight interference fit, within the notches 124 and 144.

The outer edge 162*b* of the inner end wall panel 162 is further provided with a notch 168, preferably midway along its extent (width) to allow for insertion of a users fingertip.

A second end panel 170 is formed as follows, from an outer end panel 172 and an inner end panel 162.

A first outer end panel 172 has an edge 172*a* contiguous with and of the same width (w) as the edge 104*d* of the base portion 106. In essence, the outer end panel 172 extends from the edge 104*d* of the base portion. The outer end panel 172 is rectangular, and has an edge 172*d*, parallel and opposite to the edge 172*b*, formed by a fold line.

Two additional fold lines 172*a* and 172*c* form the other two edges of the rectangular outer end panel 172, and are perpendicular to the folds (edges) 172*b* and 172*d*. The fold line 172*a* is collinear with the fold line 104*a*, and the fold line 172*c* is collinear with the fold line 104*c*. A dimension "h" is defined between the edges 172*b* and 172*d*, as the height of the outer end panel 172.

A first inner end panel 182 has an edge 182*b* contiguous with and of slightly lesser length as the edge 172*d* of the outer end panel 172 In essence, the inner end panel 182 extends from the edge 172*d* of the outer end panel 172. The inner end panel 182 is rectangular, and has an outer edge 182*d*, parallel and opposite to the edge 182*b*.

The inner end panel 182 has two additional edges 182*a* and 182*c*, which are parallel to each other, which are formed when cutting the periphery 102 of the blank, and which extend parallel to but slightly closer together than the fold lines 172*a* and 172*c* of the outer end wall 172. A dimension "h'" is defined between the edges 182*b* and 182*d*, as the height of the inner end panel 182, and is no greater than the dimension "h".

An outer corner of the inner end wall panel 182 is provided with a tab 184, extending from the edge 182*a* of the panel 182 at a position adjacent to the outer edge 182*d*. The tab 184 is delineated from the panel 182 by a fold line 185, which (as will be seen hereinbelow) allows the tab 184 to be folded at ninety degrees to the panel 182. An opposite corner of the inner end wall panel 182 is provided with a similar tab 186, extending from the edge 182*c* of the panel 182 at a position adjacent to the outer edge 182*d*. The tab 186 is delineated from the panel 182 by a fold line 187, which (as will be seen hereinbelow) allows the tab 186 to be folded at ninety degrees to the panel 182. The tabs 184 and 186 cooperate (mate) with the aforementioned notches 126 and 146, respectively, to keep the folded (assembled) box in a folded configuration. The tabs 184 and 186 are sized and shaped to fit easily but securely, such as by a slight interference fit, within the notches 126 and 146.

The outer edge 182*d* of the inner end wall panel 182 is further provided with a notch 188, preferably midway along its extent (width) to allow for insertion of a users fingertip.

The outer end panel 172 is provided with a cutout through the blank 100, forming a window 174, at a position preferably approximately at a central region of the outer end panel 172. A surface of the inner end panel 182 that will face outward when the box is assembled is provided with printing ("ABC XYZ"), or with a stick-on label or the like, which will be viewable from the exterior of the box, through the window 174, when the box is assembled. The legend ("ABC XYZ") or label is applied to the surface of the inner end wall 182 at a position corresponding to the position of the window in the outer end wall 172, when the box is assembled.

Other than for the window 174, the end wall panels 150 and 170 are essentially "mirror" images of one another.

It should be noted that the terms "outer" and "inner", as applied to the end panels, are descriptive of the ultimate position of these panels either within (inner) or without (outer) the assembled box.

"Connecting" panels are provided at the corners of the base portion 106, and join neighboring outer end and side panels, as follows:

A first connecting panel 210 is formed at one corner of the base panel 106. The panel 210 is generally square, and has:

1. an edge 210*d* contiguous with the fold line edge 112*b* of the outer side panel 112;

2. an edge 210*c* perpendicular to the edge 210*d* contiguous with the fold line edge 152*a* of the outer end panel 152;

3. an edge 210*a* formed by cutting the blank 100, generally collinear with the fold edge 112*a* of the outer side panel 112; and 4. an edge 210*b* formed by cutting the blank 100, generally collinear with the fold edge 152*b* of the outer end panel 152.

A diagonal fold line 212 is formed in the blank 100 extending from a corner of the base portion 106 formed at the intersection of the fold lines 104*a* and 104*b* to a corner of the first connecting panel 210 formed at the intersection of the edges 210*a* and 210*b* of the connecting panel 210. The fold line 212 allows the panel 210 to deform inwardly when the side panel 112 and end panel 152 are folded upward (in the process of forming the box from the blank), so that the connecting panel 210 symmetrically folds upon itself into a flat structure. Preferably, the outer corner of the connecting panel 210 formed at the intersection of the edges 210*a* and 210*b* is "relieved", by removing (cutting away) a small amount of material away from the corner at forty-five degrees, to facilitate the panel 210 folding upon itself.

A second connecting panel 220 is formed at another corner of the base panel 106. The panel 220 is generally square, and has:

1. an edge 220*d* contiguous with the fold line edge 132*b* of the outer side panel 132;

2. an edge 220*a* perpendicular to the edge 220*d* contiguous with the fold line edge 152*c* of the outer end panel 152;

3. an edge 210*c* formed by cutting the blank 100, generally collinear with the fold edge 132*c* of the outer side panel 132; and 4. an edge 210*b* formed by cutting the blank 100, generally collinear with the fold edge 152*b* of the outer end panel 152.

A diagonal fold line 222 is formed in the blank 100 extending from a corner of the base portion 106 formed at the intersection of the fold lines 104*b* and 104*c* to a corner of the connecting panel 220 formed at the intersection of the edges 210*b* and 210*c* of the connecting panel 220. The fold line 222 allows the panel 220 to deform inwardly when the side panel 132 and end panel 152 are folded upward (in the process of forming the box from the blank), so that the connecting panel 220 symmetrically folds upon itself into a flat structure. Preferably, the outer corner of the connecting panel 220 formed at the intersection of the edges 210*b* and 210*c* is "relieved", by removing (cutting away) a small amount of material away from the corner at forty-five degrees, to facilitate the panel 220 folding inward upon itself.

A third connecting panel 230 is formed at one corner of the base panel 106. The panel 230 is generally square, and has:

1. an edge 230*b* contiguous with the fold line edge 132*d* of the outer side panel 132;

2. an edge 230*a* perpendicular to the edge 230*b* contiguous with the fold line edge 172*c* of the outer end panel 172;

3. an edge 230*c* formed by cutting the blank 100, generally collinear with the fold edge 132*c* of the outer side panel 132; and 4. an edge 230*d* formed by cutting the blank 100, generally collinear with the fold edge 172*d* of the outer end panel 172.

A diagonal fold line 232 is formed in the blank 100 extending from a corner of the base portion 106 formed at the intersection of the fold lines 104*c* and 104*d* to a corner of the connecting panel 230 formed at the intersection of the edges 230*c* and 230*d* of the connecting panel 230. The fold line 232 allows the panel 230 to deform inwardly when the side panel 132 and end panel 172 are folded upward (in the process of forming the box from the blank), so that the connecting panel 230 symmetrically folds upon itself into a flat structure. Preferably, the outer corner of the connecting panel 230 formed at the intersection of the edges 230*c* and 230*d* is "relieved", by removing (cutting away) a small amount of material away from the corner at forty-five degrees, to facilitate the panel 230 folding inward upon itself.

A fourth connecting panel 240 is formed at one corner of the base panel 106. The panel 240 is generally square, and has:

1. an edge 240*b* contiguous with the fold line edge 112*d* of the outer side panel 112;

2. an edge 240*c* perpendicular to the edge 240*b* and contiguous with the fold line edge 172*a* of the outer end panel 172;

3. an edge 240*a* formed by cutting the blank 100, generally collinear with the fold edge 112*a* of the outer side panel 112; and 4. an edge 210*d* formed by cutting the blank 100, generally collinear with the fold edge 172*d* of the outer end panel 172.

A diagonal fold line 242 is formed in the blank 100 extending from a corner of the base portion 106 formed at the intersection of the fold lines 104*d* and 104*a* to a corner of the connecting panel 240 formed at the intersection of the edges 240*d* and 240*a* of the connecting panel 240. The fold line 242 allows the panel 240 to deform inwardly when the side panel 112 and end panel 172 are folded upward (in the process of forming the box from the blank), so that the connecting panel 240 symmetrically folds upon itself into a flat structure. Preferably, the outer corner of the connecting panel 240 formed at the intersection of the edges 240*d* and 240*a* is "relieved", by removing (cutting away) a small amount of material away from the corner at forty-five degrees, to facilitate the panel 240 folding upon itself.

Figure 2B:
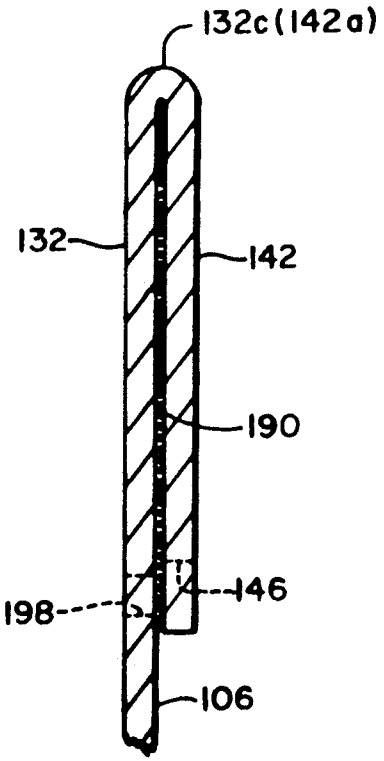
FIG. 2B is a cross-sectional view of a portion of the partially folded box of FIG. 2A, the cross-section taken on a line 2B—2B through FIG. 2A, showing the inner side panels folded over outer side panels.
Figure 2A:
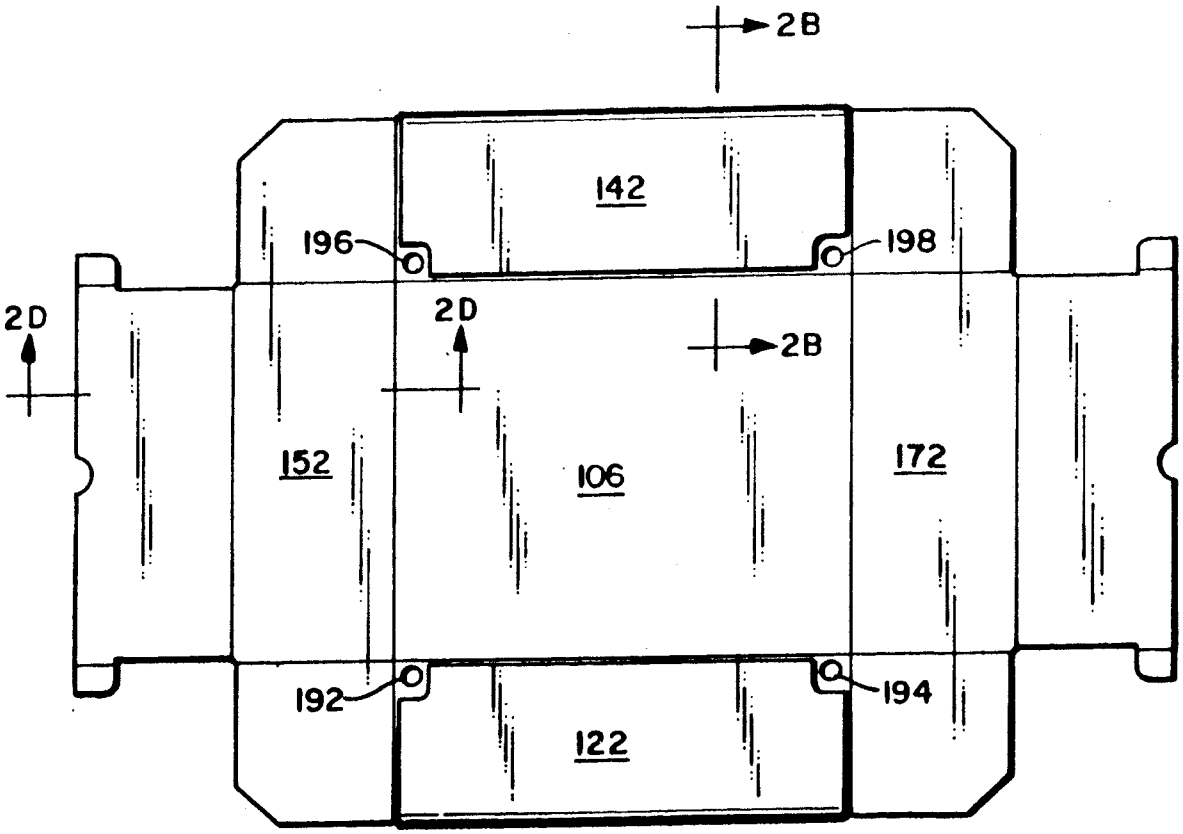
FIG. 2A is a plan view of the blank of material of FIG. 1 partially folded into a box. Specifically, the figure shows inner side panels folded over outer side panels.

FIG. 2A shows the blank 100 of FIG. 1A, partially assembled into a box. In this stage of assembly, the inner side wall portions are folded over the outer side wall portions. The inner and outer sidewall portions may be glued together at this stage, as illustrated in FIG. 2B.

More particularly, in FIG. 2A, inner sidewall panel 122 is shown folded over outer sidewall panel 112, and inner sidewall panel 142 is shown folded over outer sidewall panel 132, by folding at fold lines 112*a* (122*c*) and 132*c* (142*a*), respectively.

With reference to FIGS. 1A and 2A, it is evident that holes 192 and 194 are disposed at opposite sides of the outer side wall panel 112. These holes 192 and 194 are punched through the flat blank, and are positioned to align with the notches 124 and 126, respectively, when the blank is folded as shown in FIG. 2A.

Similarly, again with reference to FIGS. 1A and 2A, it is evident that holes 196 and 198 are disposed at opposite sides of the other outer side wall panel 132. These holes 196 and 198 are punched through the flat blank, and are positioned to align with the notches 144 and 146, respectively, when the blank is folded as shown in FIG. 2A.

Figure 2C:
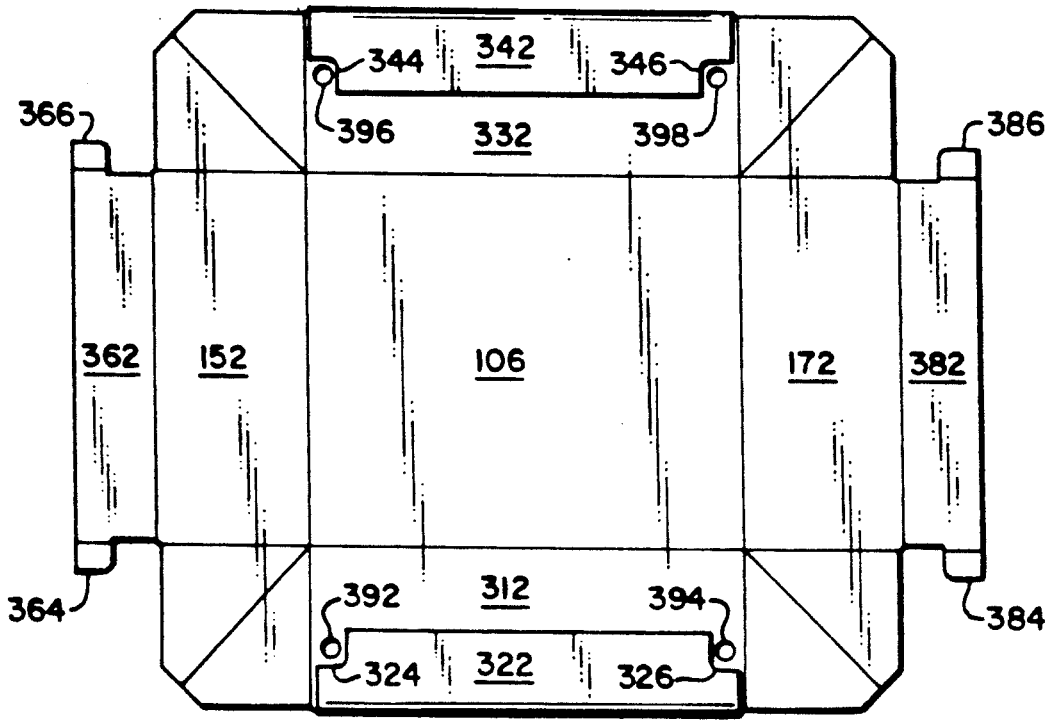
FIG. 2C is a plan view of an alternate embodiment of the box blank of FIG. 1A, shown partially folded as in FIG. 2A.
Figure 2D:
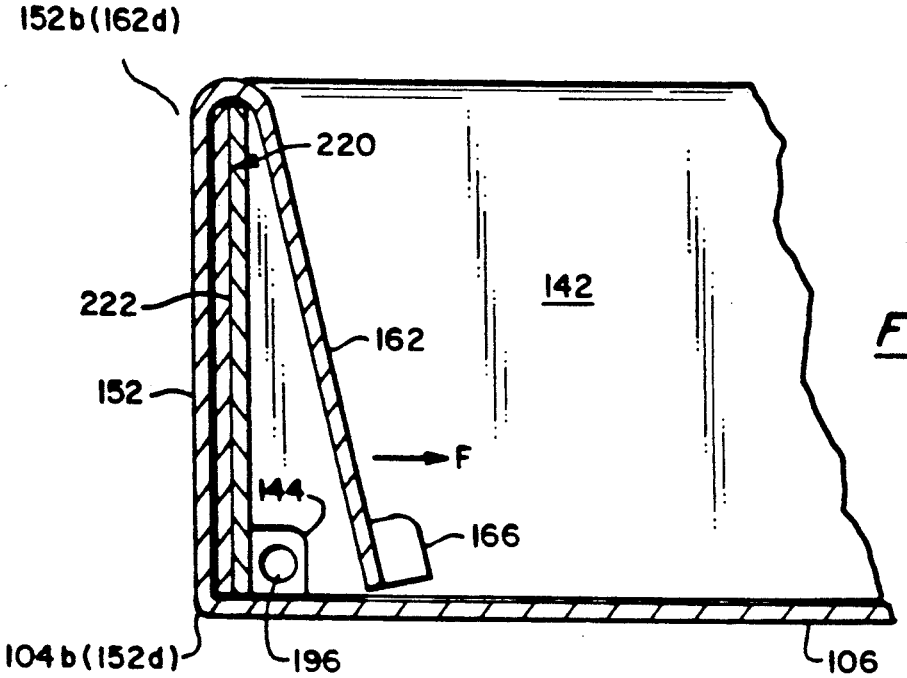
FIG. 2D is a cross-sectional view of a corner of the blank of FIG. 1A, folded into a box, taken on a line 2D—2D through FIG. 2A, showing a corner connecting panel 220 folded and interposed between an outer end panel 152 and an inner end panel 162.

FIG. 2D shows a corner of the blank 100 of FIG. 1A, folded into a box, taken on a line 2D—2D through FIG. 2A, showing a corner panel 220 folded and interposed between an outer end panel 152 and an inner end panel 162. The inner end panel 162 is shown just prior to being fully folded over the outer end panel 152, at which point the tab 166 will engage into the notch 144 in the inner side panel 142. As is evident from this view, the connecting panel 220, by virtue of being interposed between the inner end panel 162 which is folded over the outer end panel 152, exerts a biasing force "F" urging the inner end panel 162 towards the interior of the box. Such movement of the inner end panel 162 is prevented by the interlocking fit of the tab 166 in the notch 144. However, when the tab 166 is released from the notch 144, such as by poking a finger through the hole 196 from the exterior of the box, the tab will release, and the inner end panel 162 will "automatically" begin to unfold.

Figure 5A:
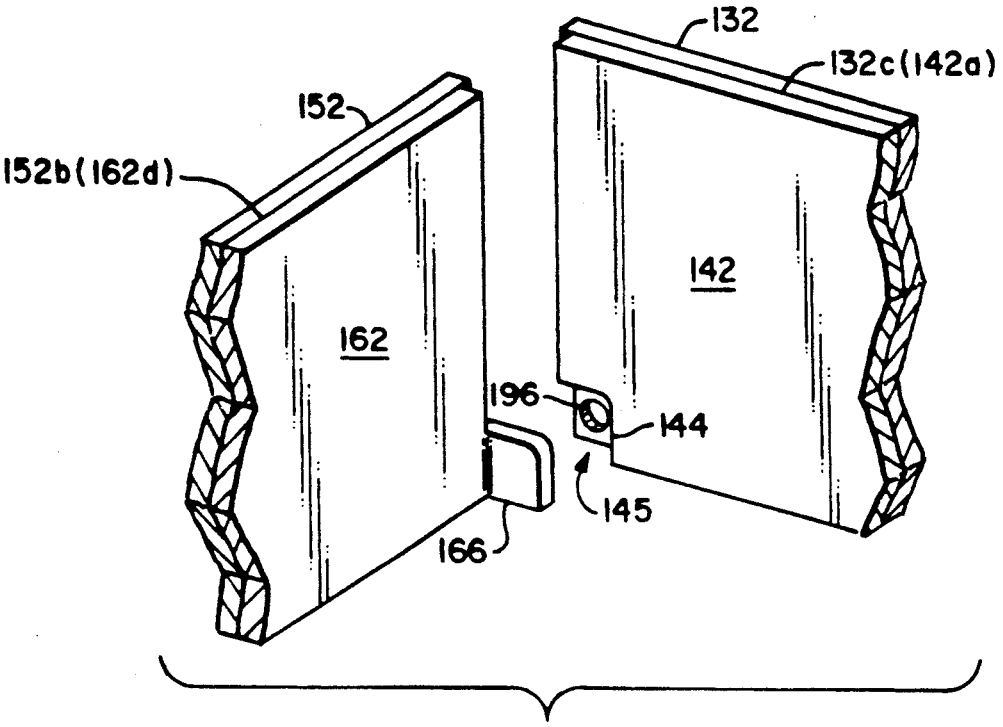
FIG. 5A is a partial, exploded view of an interior corner of the blank of FIG. 1A, folded into a box structure.

FIG. 5A is a detailed view of how the tabs 164, 166, 184 and 186 cooperate with the notches 124, 144, 126 and 146, respectively, and with the holes 192, 196, 194, and 198, respectively, to hold the box together when erected. The illustrated example applies to all of these, but shows only one exemplary tab (flap) 166, notch 144, hole 196 combination. Other elements of the box are not shown in the Figure, for illustrative clarity.

First of all, the tab 166 is bent at right angles to the inner end panel 162 to be parallel with the inner side panel 142 and pointing towards the interior of the box. As is evident in the Figure, the contour (profile) of the tab 166 is closely matched to that of the notch 144. In this manner, the tab "snaps" neatly into a recess 145 formed by the notch 144, against the outer end panel 132. And, as is evident, the hole 196 is aligned with the notch so that the tab can be un-seated from the recess 145 formed by the notch 144 when it is desired to disassemble the box.

FIG. 2B shows the inner side panel 142 folded at fold line **132*c* (142*a*) over the outer side panel 132, and an adhesive 190 (shown as dots) holding these two panels together. The alignment of the notch 146 and the hole 198 is also evident in this view. The inner side panel 122 would be folded over the outer side panel 112** in a similar manner.

FIG. 2C shows an alternate embodiment of the invention, where the inner side and end wall panels are shortened (vis-a-vis FIG. 1A). In this case, a blank 300 of sheet material is formed much like the blank 100 of FIG. 1A, with the following differences:

A first inner side wall panel 322 (compare 122 of FIG. 1A) is shorter than the outer side wall panel 312 (compare 112 of FIG. 1A), perhaps only half as high. This relocates the notches, now 324 and 326, to a position further away from the base panel (i.e., than the notches 124 and 126 were in FIG. 1A). Consequently, the aligned holes, now 392 and 394 are repositioned to align with the notches 324 and 326, respectively.

Similarly, a second inner side wall panel 342 (compare 142 of FIG. 1A) is shorter than the outer side wall panel 332 (compare 132 of FIG. 1A), perhaps only half as high. This relocates the notches, now 344 and 346, to a position further away from the base panel, when the box is folded. Consequently, the aligned holes, now 396 and 398 are repositioned to align with the notches 344 and 346, respectively.

A first inner end panel 362 (compare 162 of FIG. 1A) is shorter than the outer end wall panel 152 (compare 152 of FIG. 1A), perhaps only half as high. This relocates the tabs, now 364 and 366, to a position further away from the base panel (i.e., than the tabs 164 and 166 were in FIG. 1A), when the box is folded. The tabs 364 and 366 are nevertheless aligned (when the box is folded) with the notches 324 and 344 and holes 392 and 396, respectively.

Similarly, a second inner end panel 382 (compare 182 of FIG. 1A) is shorter than the outer end wall panel 172 (compare 172 of FIG. 1A), perhaps only half as high. This relocates the tabs, now 384 and 386, to a position further away from the base panel (i.e., than the tabs 184 and 186 were in FIG. 1A), when the box is folded. The tabs 384 and 386 are nevertheless aligned (when the box is folded) with the notches 326 and 346 and holes 394 and 398, respectively.

In either case (FIG. 1A or FIG. 2C) the notch-aligned holes (192, 194, 196, 198, or 392, 394, 396, 398) allow/encourage the respective tabs (164, 184, 166, 186, or 364, 384, 366, 386, respectively) to "catch" removably in the respective notches when the box is assembled.

Figure 3A:
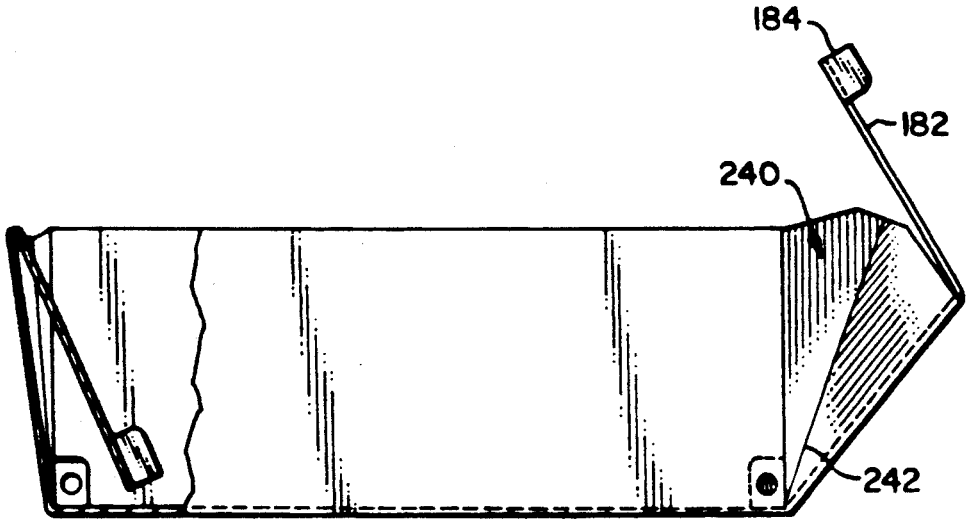
FIG. 3A is a side view of the blank of FIG. 1A, nearly fully folded, showing a connecting portion being folded between the inner and outer end wall portions.

FIG. 3A shows the blank 100 of FIG. 1A nearly completely folded into a box structure. In this view we can see that the diagonal fold line 242 allows the connecting portion 240 to deform inwardly (towards the interior of the box) as the inner end panel 182 is being folded.

Figure 4A:
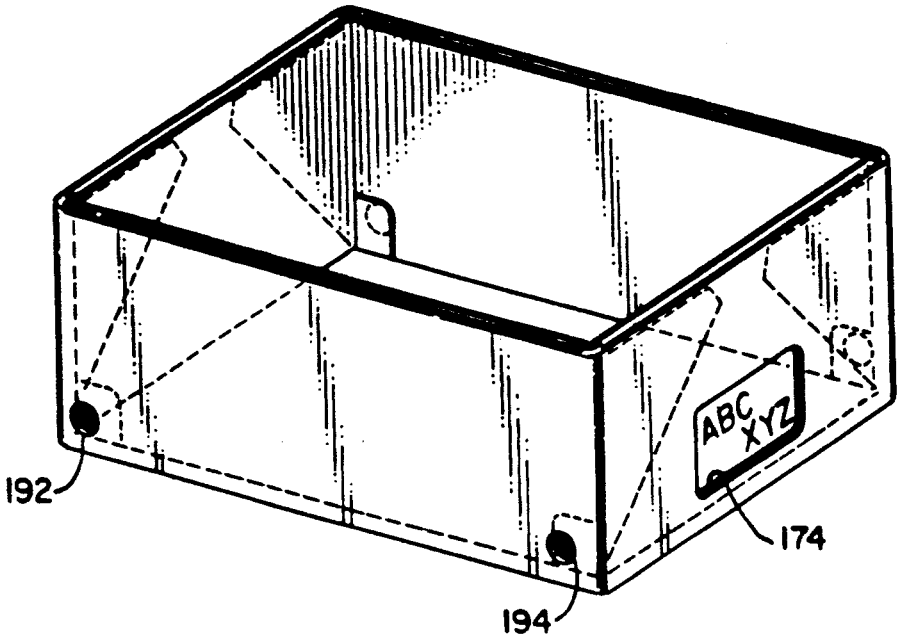
FIG. 4A is a perspective view of the fully assembled box of FIG. 1A.

FIG. 4A shows the completed box assembly, formed of the blank 100 of FIG. 1A. In this view, the window 174 in the outer end panel 172 is see to allow the printed matter ("ABC XYZ") on the outer surface of the inner end panel 182 to be viewed from exterior the assembled box.

As noted with respect to FIG. 5A, upon folding of the inner end wall panels, the tabs (arresting flaps) connected thereto are folded at right angles such that they extend parallel to the side walls, into the interior of the box. With the inner end wall panels completely folded (over the outer end wall panels and around the interposed, flat-folded connecting portions), the tabs (flaps) and the recesses (formed by the notches) are complementary to each other, such that the flaps (tabs) engage or audibly snap into the associated recesses (notches) in response to the user (box assembler) urging the tabs outward into the recesses. This tab/recess engagement is maintained by the inwardly (towards the interior of the box) directed bias (tension) exerted by the inner end wall panels trying to unfold. This is due, in part, to the elasticity (spring tension) of the folds—namely, when the inner end panel is folded over the outer end panel, the fold connecting the two panels (e.g., the fold **152*b*/162*d* connecting outer end wall panel 152 and inner end wall panel 162**) will naturally try to unfold itself. The bias on the inner end wall panel is also due to the presence of the folded-flat connecting portion, interposed between the folded inner and outer end wall portions, creating a biasing tension urging the inner end wall portion towards the interior of the box. The recess (notch) in the inner side wall, however, provides a positive engagement for the tab (flap), and prevents the inner end wall from unfolding itself.

Advantageously, the inward bias on the inner end panels resulting from the interposed flat-folded connecting portions (panels) can be adjusted by adjusting the size of the connecting panel itself. Whereas FIG. 1A described the connecting panels as being squares of dimension "h"×"h", in other words, coextensive with the respective outer end panel edge (e.g., **152*a*) and outer side panel edge (e.g., 112*b*), the connecting panels can be made smaller to exert a decreased inward bias on the inner end panel. This is shown in FIG. 1 by the dashed line on the connecting panel 210**, which could be made a dimension "m" smaller than the dimension "h" of the corresponding edges of the associated outer end and side panels. This reduction in dimension "m", can be empirically determined, and is expected to be on the order of 5–25% of "h".

Figure 6A:
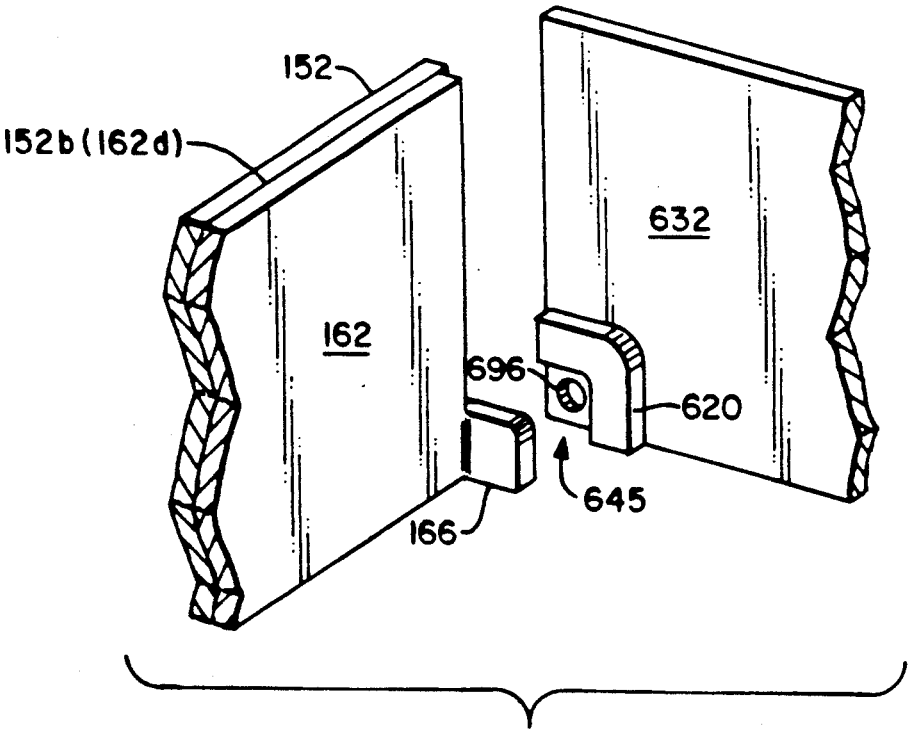
FIG. 6A is a partial, exploded view of an interior corner of a box, formed according to the present invention, using a single rather than double side wall construction, and additional, discrete reinforcing strips to create a recess for the tabs of the end panels to insert into.

FIG. 6A, similar to FIG. 5A, shows an alternative to the double side wall construction of FIG. 5A. Herein, rather than having an inner side wall (e.g., 142) folded over an outer side wall (e.g., 132), a single side wall construction is used. In this case, a single-thickness outer side wall 632 (analogous to 132) is provided with a hole 696 (analogous to 196). Since there is not provided a discrete inner side wall (e.g., 142) having a notch forming the recess for the tab 166, a separate strip or strips of material 620 are disposed to form a recess 645 (corresponding to the recess 145 of FIG. 5A) for receiving and retaining the associated tab 166. There can be a short strip of material 620, as shown, for each recess, or there can be one long strip disposed along the side wall 632 forming the required recessed at both ends of the side wall 632.

It should be understood that the box of the present invention can be formed of any suitable blank sheet material, including stiff paper stock, corrugated stock, and the like.

It should also be understood that the arrangement of the tabs on the end panels, and the notches on the side panels could be reversed; namely by putting the tabs on the side panels and the notches on the end panels. In such a reversed arrangement, it would still be preferred that the connecting panels reside between the inner and outer side panels having tabs, so that the inner side panel is urged inward towards the center of the in the plane of the end panel.

In the manner set forth above, a blank of sheet material is easily and repeatedly folded into a five-sided container shape. The resulting container can be used by itself, or to close another open container. For example, two container formed according to the present invention can be used to close the two open ends of an otherwise open (at both ends) container.

Appended hereto, and forming part of the disclosure hereof, is a document entitled "Folded Box". This document is a description of the present invention in terms substantially similar to the description set forth above. Certain features of the invention may be set forth with additional clarity in the appendix, and are specifically intended to be incorporated by reference into the present disclosure.

What is claimed is:

1. A box adapted to be folded from a flat blank of sheet material, the box comprising:

a bottom portion;

two side walls, each side wall connected via a fold to one of two first opposing edges of said bottom portion;

two end walls, each end wall having an outer end wall portion connected via a fold to one of two second opposing edges of said bottom portion, and an inner end wall portion connected via a fold to the outer end wall portion;

said second opposing edges of said bottom portion extending perpendicular to said first opposing edges of said bottom portion;

a plurality of connecting portions, each connecting portion connected to a pair of intersecting edges of one of the two side walls and one of the two outer end wall portions;

each connecting portion symmetrically foldable about a fold line extending diagonally from a corner of said bottom portion such that in an erected state of said box said connecting portion is folded and received between the inner and outer end wall portions of one of the two end walls; and a plurality of engaging means for engaging and resiliently arresting movement of the inner end wall portions, and for retaining the inner and outer end wall portions in a folded upright position, each engaging means having:

a plurality of arresting flaps, each arresting flap projecting from an inner end wall portion from an edge of the inner end wall portion facing an adjacent side wall, the arresting flap extending in parallel to said adjacent side wall; and recess means correspondingly formed in said side walls for engagingly receiving said arresting flap;

and wherein:

said side walls are provided with holes at positions corresponding to said recess means, for enabling said arresting flap to be unengaged from said recess means.

2. The box of claim 1, wherein:

each of the two side walls comprise an outer side wall portion connected to said bottom portion, and an inner side wall portion connected by a fold to the outer side wall portion;

said recess means are disposed at an edge region of each of said inner side wall portions.

3. The box of claim 2, wherein:

said holes are provided in said outer side wall portions.

4. The box of claim 1, wherein:

said recess means comprises strip means attached to inner surfaces of said side walls.

5. The box of claim 1, further comprising:

a notch disposed along an outer, free edge of at least one of the two inner end wall portions, for facilitating unfolding the end wall.

6. The box of claim 2, wherein:

said inner end wall portions are shorter than said outer end wall portions; and said inner side wall portions are shorter than said outer side wall portions, and correspond in height to said inner end wall portions.

7. The box of claim 2, wherein:

a part of each of said connecting portions facing an exterior wall portion of each of said end walls is fixed thereto.

8. The box of claim 1, wherein:

a viewing window is provided through at least one of said outer end wall portions.

9. The box of claim 1, wherein:

the box is employed as a bottom box element; and another box is formed, similar to the bottom box element, and is used as ad cover box element.

10. The bottom box element and cover box element of claim 9, wherein:

said bottom box element and said cover box element have slightly different dimensions so that the cover box element fits securely over the bottom box element, thereby forming a composite, closeable box.

11. The bottom box element and cover box element of claim 9, further comprising:

a flat foldable intermediate element fitting with opposite ends into said bottom box element and into said cover box element, respectively.

12. A flat blank of sheet material having an outer periphery and provided with a pattern of fold lines defining various panels and adapted to be formed into a box structure, the flat blank of sheet material comprising:

a rectangular, generally planar base panel defied by first two parallel fold lines and second two parallel fold lines perpendicular to the first two parallel fold lines;

a first, generally rectangular, outer side wall panel extending from one of the first two parallel fold lines and defined by said one of the first two parallel fold lines, a second fold line parallel to said one of the first two parallel fold lines, and two parallel end fold lines perpendicular to said one of the first two parallel fold lines;

a second, generally rectangular, outer side wall panel extending from another of the first two parallel fold lines and defined by said other of the first two parallel fold lines, a second fold line parallel to said other of the first two parallel fold lines, and two parallel end fold lines perpendicular to said other of the first two parallel fold lines;

a first, generally rectangular, outer end wall panel extending from one of the second two parallel fold lines and defined by said one of the second two parallel fold lines, a second fold line parallel to said one of the second two parallel fold lines, and two parallel end fold lines perpendicular to said one of the second two parallel fold lines;

a second, generally rectangular, outer end wall panel extending from another of the second two parallel fold lines and defined by said other of the second two parallel fold lines, a second fold line parallel said other of the second two parallel fold lines, and two parallel end fold lines perpendicular said other of the second two parallel fold lines;

a first, generally rectangular, inner side wall panel extending from the second fold line of the first outer side wall panel, and further defined by the outer periphery of the blank;

a second, generally rectangular, inner side wall panel extending from the second fold line of the second outer side wall panel, and further defined by the outer periphery of the blank;

a first, generally rectangular, inner end wall panel extending from the second fold line of the first outer end wall panel, and further defined by the outer periphery of the blank;

a second, generally rectangular, inner end wall panel extending from the second fold line of the second outer end wall panel, and further defined by the outer periphery of the blank;

a first, generally square, connecting panel disposed at one corner of the base panel and defined by one of the two parallel end fold lines of the first outer side wall panel and one of the two parallel end fold lines of the first outer end wall panel;

a second, generally square, connecting panel disposed at another corner of the base panel and defied by the other of the two parallel end fold lines of the first outer end wall panel and one of the two parallel end fold lines of the second outer side wall panel;

a third, generally square, connecting panel disposed at one corner of the base panel and defined by the other of the two parallel end fold lines of the second outer side wall panel and one of the two parallel end fold lines of the second outer end wall panel;

a fourth, generally square, connecting panel disposed at another corner of the base panel and defined by the other of the two parallel end fold lines of the second outer end wall panel and the other of the two parallel end fold liens of the second outer side wall panel;

a first diagonal fold line extending diagonally across the first connecting panel so that the first connecting panel can be folded flat when the first outer side wall panel and the firs outer end wall panel are folded out-of-plane with respect to the base panel, and so that the first connecting panel can be further disposed between the first inner end wall panel and first outer end wall panel when the first inner end wall panel is folded against the first outer end wall panel;

a second diagonal fold line extending diagonally across the second connecting panel so that the second connecting panel can be folded flat when the second outer side wall panel and the first outer end wall panel are folded out of the plane of the base panel, and so that the second connecting panel can be further disposed between the first inner end wall panel and first outer end wall panel when the first inner end wall panel is folded against the first outer end wall panel;

a third diagonal fold line extending diagonally across the third connecting panel so that the third connecting panel can be folded flat when the second outer side wall panel and the second outer end wall panel are folded out of the plane of the base panel, and so that the third connecting panel can be further disposed between the second inner end wall panel and second outer end wall panel when the second inner end wall panel is folded against the second outer end wall panel;

a fourth diagonal fold line extending diagonally across the fourth connecting panel so that the fourth connecting panel can be folded flat when the first outer side wall panel and the second outer end wall panel are folded out of the plane of the base panel, and so that the fourth connecting panel can be further disposed between the second inner end wall panel and second outer end wall panel when the second inner end wall panel is folded against the second outer end wall panel;

a first notch formed at a first corner of the first inner side wall panel;

a second notch formed at a first corner of the second inner side wall panel;

a third notch formed at another corner of the second inner side wall panel;

a fourth notch formed at another corner of the first inner side wall panel;

a first tab formed at a first corner of the first inner end wall panel, and adapted to fit engagingly into the first notch when the box structure is assembled;

a second tab formed a another corner of the first inner end wall panel, and adapted to fit engagingly into the second notch when the box structure is assembled;

a third tab formed at another corner of the second inner end wall panel, and adapted to fit engagingly into the third notch when the box structure is assembled;

a fourth tab formed at a first corner of the second inner end wall panel, and adapted to fit engagingly into the fourth notch when the box structure is assembled;

the first connecting panel being disposed between the first outer end wall panel and first inner end wall panel, and exerting a force on the first inner end wall panel maintaining the first tab securely within the first notch;

the second connecting panel being disposed between the first outer end wall panel and first inner end wall panel, and exerting a force on the first inner end wall panel maintaining the second tab securely within the second notch;

the third connecting panel being disposed between the second outer end wall panel and second inner end wall panel, and exerting a force on the second inner end wall panel maintaining the third tab securely within the third notch;

the fourth connecting panel being disposed between the second outer end wall panel and second inner end wall panel, and exerting a force on the second inner end wall panel maintaining the fourth tab securely within the fourth notch;

a first hole disposed in the first outer sidewall panel in alignment with the first notch and the first tab when the box,structure is assembled, for releasing the first tab from engagement with the first notch;

a second hole disposed in the second outer sidewall panel in alignment with the second notch and the second tab when the box structure is assembled, for releasing the second tab from engagement with the second notch;

a third hole disposed in the second outer sidewall panel in alignment with the third notch and the third tab when the box structure is assembled, for releasing the third tab from engagement with the third notch; and a fourth hole disposed in the first outer sidewall panel in alignment with the fourth notch and the fourth tab when the box structure is assembled, for releasing the fourth tab from engagement wthi the fourth notch.

* * * * *

UNITED STATES PATENT AND TRADEMARK OFFICE

CERTIFICATE OF CORRECTION

PATENT NO. : 5,211,330

DATED : May 18, 1993

INVENTOR(S) : Albert Frey

It is certified that error appears in the above-identified patent and that said Letters Patent is hereby corrected as shown below:

On the Title page, item [54] and col. 1, line 1,
The title "FIVE-SPEED BOX . . . "
should read -- FIVE-SIDED BOX . . . --

Signed and Sealed this
Fifth Day of April, 1994

*Attest:*

*Attesting Officer*

Bruce Lehman

BRUCE LEHMAN

*Commissioner of Patents and Trademarks*